United States Patent [19]

Alter

[11] 4,276,458

[45] Jun. 30, 1981

[54] SWITCH ARRANGEMENT WITH SWITCH CONTACTS WHICH CAN BE CHANGED AS DESIRED TO NORMALLY OPEN OR NORMALLY CLOSED OPERATION

[75] Inventor: Siegfried Alter, Solingen-Gräfrath, Fed. Rep. of Germany

[73] Assignee: Metzenauer & Jung GmbH, Wuppertal, Fed. Rep. of Germany

[21] Appl. No.: 89,812

[22] Filed: Oct. 31, 1979

[30] Foreign Application Priority Data

Nov. 6, 1978 [DE] Fed. Rep. of Germany ..... 2848105

[51] Int. Cl.[3] ..... H01H 3/14

[52] U.S. Cl. ..... 200/153 J; 200/160; 200/320; 200/327; 200/16 A

[58] Field of Search ..... 200/153 J, 153 D, 153 S, 200/160, 307, 320, 327, 328, 243, 16 R, 16 A, 16 B, 16 C

[56] References Cited

U.S. PATENT DOCUMENTS

| | | | |
|---|---|---|---|
| 2,752,441 | 6/1956 | Frank | 200/328 |
| 3,436,497 | 4/1969 | Mading | 200/243 |
| 3,982,090 | 9/1976 | Lewis | 200/153 J |
| 4,064,381 | 12/1977 | Mullen et al. | 200/16 A |
| 4,112,277 | 9/1978 | Kleeb | 200/153 J |

*Primary Examiner*—Willis Little

*Attorney, Agent, or Firm*—Martin A. Farber

[57] ABSTRACT

Switch arrangement with switches completely equipped both for normally closed and for normally open operation, in which, by means of an insulating part which can be selectively placed operatively with respect to the contact pieces which cooperate as breaker or the contact pieces which cooperate as maker, one type of operation in each case is blocked. For this the insulating part has abutment stops, which in both inserted positions in each case lie outside the contact places and which assure an air spacing between the contact pieces which thereby are blocked from making contact.

12 Claims, 9 Drawing Figures

Figure 1:
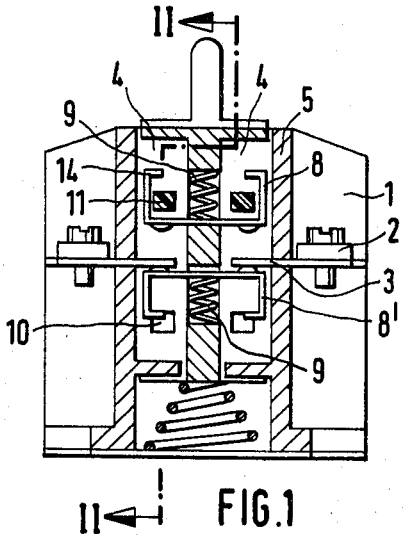

SWITCH ARRANGEMENT WITH SWITCH CONTACTS WHICH CAN BE CHANGED AS DESIRED TO NORMALLY OPEN OR NORMALLY CLOSED OPERATION

The invention relates to a switch arrangement fully equipped for normally open as well as normally closed operation, and in which one type of function is blocked in each case by an insulating part which can be placed as desired between the contact pieces which cooperate as normally closed or as normally open contacts.

Such a switch arrangement is known in various structural forms from West German Pat. No. 19 40 042. In it, the switches of variable function are equipped both with the switch contacts necessary for the normally closed operation and with those necessary for the normally open operation, the switch contacts for one of the two functions being prevented in each case from making contact by the optionally changeable insulating part. Such switch arrangements which can be varied as desired in their contact function are increasingly desired in control engineering both in the case of manually actuated switches and in the case of automatically actuated contacts, for instance in connection with contactor relays. The switching of the contact functions is in this case to be effected as simply as possible, without the addition of auxiliary parts.

In the switch arrangements pursuant to West German Pat. No. 14 90 042, the insulating parts consist of small, relatively thin-walled insulating coatings on the fixed or movable contact members and are subjected to mechanical and possibly also thermal stresses upon each actuation of the switch. As a result of their arrangement in the immediate vicinity of the contact places, insulation defects or leakage paths can result after lengthy use, whereby the reliability in opertion of the switch arrangement is endangered. In addition, the known switches must be taken extensively apart in order to be able to carry out the somewhat difficult work of reinserting or changing the relatively small insulating parts. The change in function can be effected therein only by such action within the device that the possibility of impairing the reliability in operation cannot be excluded. Furthermore, in the known switch arrangements there is no possibility of also positively changing the designation of the terminals at the same time as the switching of the function, so that these known switch arrangements no longer satisfy the requirements made today as to the designation of terminals.

The object of the present invention is to improve the known switch arrangements in such a manner that the changeability of the contact function (normally open or closed) is obtained without impairing the reliability in operation and the resistance to wear of the switch arrangement.

Starting from a switch arrangement in accordance with the type indicated above, the solution of this task is achieved in accordance with the invention by the fact that the insulating part, in both of the positions of insertion, has stops which lie outside the contact places and assure an air spacing between the contact pieces which are blocked upon the making of contact. In the invention, the insulating part satisfies directly only the stop function, its insulating purpose being achieved merely indirectly by assuring an air space between the contact pieces which are to be blocked. The stops which are arranged outside the contact places can now be made strong and very resistant to wear so that even after a long period of use the insulating air spacing between the blocked contact pieces is definitely retained; the stops can therefore also possibly be developed as metal parts.

Figure 9:
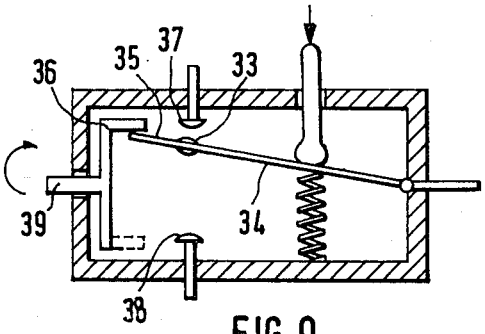

In carrying out the invention it can furthermore be seen to it that the insulating part is changeable on the outside of the housing of the switch arrangement. In this way the advantage is obtained that the switch arrangements need no longer be taken apart for a change in function, it being rather merely necessary to remove for instance from the housing the insulating part which had been placed on the housing and place it back then on the housing in a position which has been turned 180°. In this way a change in function can be carried out in a very simple manner without endangering the dependability of operation of the switch arrangement. The part which changes the switch function can also be fastened permanently to the housing but in such a manner that it can be turned by 180° (FIG. 9).

As a further development of the invention it can furthermore be provided that the changeable insulating part bear at its upper and its lower ends terminal designations for both normally closed and normally open operation, only the applicable designations lying, depending on the position of installation, on the visible side of the switch arrangement. In this connection the insulating part can also be developed in such a manner that it so covers terminal designations, which are provided on the housing for the two types of operation that in each case only the function symbol of the type switch operation set is legible. By these measures assurance is provided that at the same time as a change in the type of operation, the terminal designations present at the connecting terminals are also correctly changed positively.

Further features indicated in the dependent claims serve to characterize certain very suitable structural embodiments of the subject matter of the invention.

Figure 2:
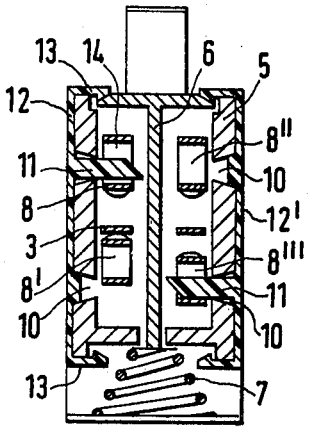
Figure 3:
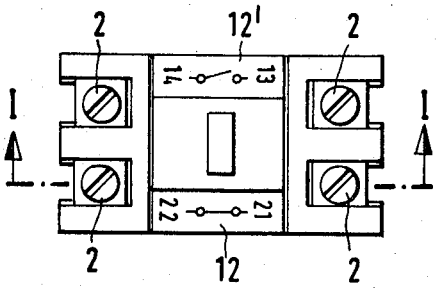
Figure 4:
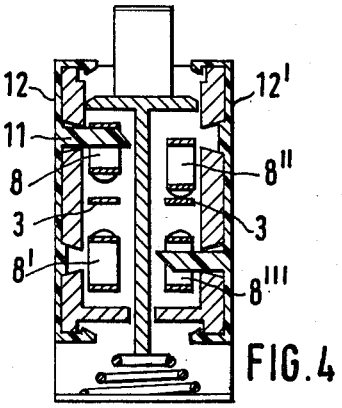
Figure 5:
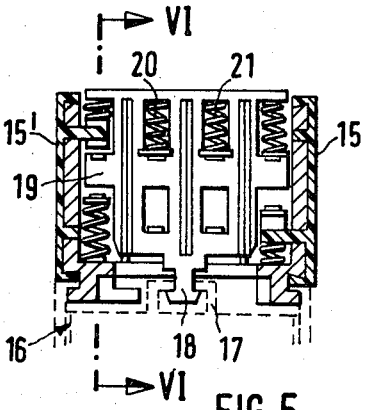
Figure 6:
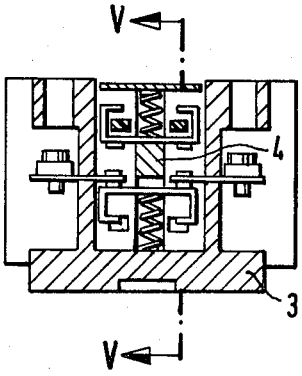
Figure 7:
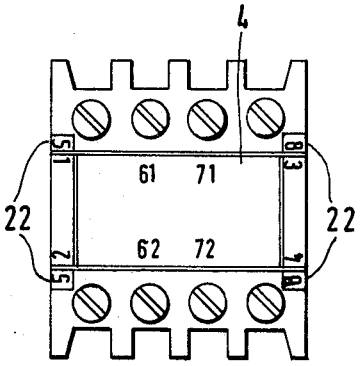
Figure 8:
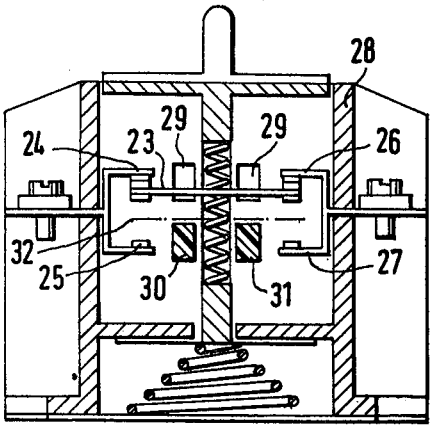

The invention will be described in further detail below with reference to several illustrative embodiments shown in the drawing in which:

FIG. 1 is a section through the switch chamber of a manually actuated switch arrangement in accordance with the invention, FIG. 2 is a section along the line II—II of FIG. 1, FIG. 3 is a top view of the switch of FIG. 1, FIG. 4 shows the switch in a view similar to FIG. 2, but in actuated position, FIG. 5 is a section through the switch adapter of a four-pole switch attachment part for a four-pole contactor relay, FIG. 6 is a section along the line VI—VI in FIG. 5, FIG. 7 is a top view of the switch adapter showing the changeable terminal designations, FIG. 8 shows another embodiment for a manually actuated switch arrangement in accordance with the invention, and FIG. 9 shows an optionally switchable switch arrangement with adjustment knob.

FIGS. 1 to 4 show the switch housing 1 of a mechanically actuated two-pole switch with the four connecting terminals 2; the pairs of fixed contacts 3, and the two switch chambers 4 which are formed on the one hand by the walls 5 of the housing and on the other hand by the central wall of the movable switch cross-member 6 which is pressed into its end position by a spring 7.

Within each switch chamber there are two movable switch bridges 8, 8', 8'', 8''' both of which, depending on the position of the switch cross-member 6 come to rest against the pairs of fixed contacts 3 and make contact. The movable switch bridges 8 to 8''' are supported via springs 9 in the switch cross-member 6.

In the side walls 5 of the housing 1 there are provided, in accordance with the invention a plurality of openings 10 to receive and permit the passage of pin-shaped stops 11 which are arranged on an insulating part 12, 12' which can be placed laterally on the side walls 5 and fastened there by means of the resilient detent arms 13.

The two pin-shaped stops 11 of each insulating part 12, 12' extend in this connection into the region of motion of the backward bends 14 of the C-shaped switch bridges 8 and 8''' and, by constricting the path prevent the making of contact by these movable switch bridges with the fixed contact pairs 3. The stops 11 lie at a considerable distance from the contact places. Depending on whether the insulating part 12 is inserted in the one position or in the other position which is turned 180° with respect to it, the breaking or making bridge is prevented from making contact. In FIGS. 2 and 4 the switch chamber shown on the left is shown as breaker and the switch chamber on the right as maker. Accordingly, the movable switch bridge 8' of the left chamber makes contact with the pair of fixed contacts 3 while in the right-hand switch chamber the switch bridge 8''' is prevented from making contact by the blocking members 11, a large air space which assures dependable insulation being provided between the fixed contact pieces 3 and the contact pieces of the blocked switch bridge 8'''. Upon actuation of the switch cross-member 6, the movable switch bridge 8 on the left comes now, as shown in FIG. 4, to rest against the blocking members 11 and thus no longer has any functional importance, while in the right-hand switch chamber the movable switch bridge 8'' as maker makes contact with the pair of fixed contacts 3. On the ends of the switchable insulating parts 12, 12' there are imprinted terminal designations which in each case are covered on the bottom in the housing and can be read from above. As can be noted from FIG. 3, the insulating part 12 of the left switch chamber which is inserted for the "normally closed " type of operation has the terminal designations 21, 22 while the insulating part 12' bears the terminal designations 13, 14 for "normally open" operation. In the embodiment shown in FIGS. 1 to 4, the insulating parts 12, 12' are of identically the same development except for the orientation of their imprint.

In the case of the auxiliary switch adapter explained in FIGS. 5, 6 and 7 for an auxiliary contactor or relay, the variable contacts are located in the outer chambers and thus once again accessible to the influence of the changeable insulating parts 15, 15'. Since the change in function is in this way simple and unproblematic, the three different auxiliary switch adapters which previously had to be kept on stock are now reduced to only one.

The four-pole adapter is pushed laterally onto the auxiliary contactor 16 and fastened there. In this connection the driver device 17 connects with the driver 18 of the movable switch cross-member 19 and thus connects the contactor relay and the adapter to form a single functional unit.

Since the middle contacts 20, 21 remain unchanged, their terminal designation, in this case, "61," "62" and "71," "72", is also imprinted without change. Variable terminal designations are associated with the variable contacts lying on the right and left, which can be effected in the manner explained with reference to FIG. 3.

In order, however, to be able to uniformly imprint the insulating parts 15, 15' which are responsible for the change in function it is also possible to print these parts merely with the functional numbers "1-2," "3-4" and to allow them, to combine with the place numbers, for instance "5" and "8" arranged on the designation panels 22 of the adapter housing, so as to form two-digit standardized designations such as "51," "52," "83" and "84". In this way a confusing of the parts 15, 15' would be unimportant since the imprint is the same both for the left side and for the right side. If this non-confusability is to be obtained also in the case of an imprint in accordance with FIG. 3, the parts 12, 12' would have to be developed somewhat different from each other, for instance by adding an engagement projection in such a manner that the insulating part 12 can be placed exclusively on the left-hand side of the switch housing and the insulating part 12' exclusively on the right-hand side.

FIG. 8 shows a switch arrangement in which each contact piece of a movable switch bridge 23 lies between a pair of fixed contact pieces 24/25, 26/27 which are electrically connected with each other. The housing 28 has openings 29, 30 which are directed towards the two end positions of the switch bridge 23 and through which the blocking pins 31 provided on insulating parts like the plates in accordance with the first embodiments can be inserted from the outside in such a manner that the switch bridge 23 in each case can make contact only on one side with the fixed contacts 24 to 27. In the position shown, the switch is developed as a normally closed switch. In order to convert it into a normally open switch, the insulating part is removed and—with the switch cross-member depressed—inserted by means of its blocking pins into the upper openings 29 in a position which has been turned 180°, whereupon the switch bridge assumes the dashed-line position 32.

FIG. 9 shows a switch whose movable contact piece 33 is seated on a switch lever 34 which extends via an extension 35 into a stop angle 36 which, in the position shown, blocks the making of contact with the fixed contact 37 and permits only the making of contact with the other fixed contact 38 (normally open operation). The stop angle 36 is seated on a pivot pin 39 extending out of the housing. By turning the pin 39 by 180° the type of operation of the switch is changed.

I claim:

1. In a switch arrangement with switches fully equipped both for normally closed and for normally open switch operation, in which, by an insulating part which can be selectively placed operatively with respect to the contact pieces cooperating as breaker or the contact pieces cooperating as maker, the contact pieces defining cooperative contact places, one type of switch operation respectively in each case is blocked, the improvement comprising a housing, the contact pieces are operatively disposed inside of said housing, an insulating part is formed with abutment stops, said insulating part is mountable on said housing in two selective installed positions, in both of the installed positions said abutment stops are disposed outside of the contact places and operatively abut and block one of the cooperating contact pieces from making contact, with an air space between said cooperating contact pieces.

2. The switch arrangement according to claim 1, wherein, said insulating part is transposeable on an outside of said housing.

3. The switch arrangement according to claim 2, further comprising a movable switch bridge and a fixed contact, the latter being fixed to said housing, said switch bridge and said fixed contact have said contact pieces thereon, the insulating part is formed by a housing side wall having said abutment stops extending into respectively a path of movement of said moveable switch bridge to be blocked, and said housing side wall is attachable to said housing turnable by 180°.

4. The switch arrangement according to claim 1, wherein, said housing has a fixed housing side wall defining openings, said stops comprise pins which pass through said openings in said fixed housing side wall, a plate, said pins are arranged on said plate, said plate constituting said insulating part is fastened in front of said housing side wall and turnable by 180°.

5. The switch arrangement according to claim 4, further comprising a pair of fixed contacts and two movable switch bridges, the latter enclose said pair of fixed contacts therebetween, the contact pieces are disposed on said fixed contacts and said moveable switch bridges, said pair of fixed contacts are fixed to said housing, said housing, on both sides of the pair of fixed contacts, has said openings, said openings are aligned with the path of movement of said two moveable switch bridges.

6. The switch arrangement according to claim 5, wherein each of said contact pieces of a said moveable switch bridge is disposed between a pair of fixed said contact pieces, the latter are electrically connected with each other, said housing on both sides of a center line relative to said fixed contact pieces forms reception openings, said stops comprising said pins extend through said reception openings, respectively.

7. The switch arrangement according to claim 3, or 4, wherein said plate constituting said insulating part, and respectively, the turnable said housing side wall on upper and lower face ends thereof bear terminal designations, in each case respectively, for normally closed and normally open operation.

8. The switch arrangement according to claim 7, wherein said housing has terminal designations fixed thereon, said plate constituting the insulating part covers the terminal designations fixed on the housing for both types of operation such that respectively in each case only a function symbol of the switch operation which is set is legible.

9. The switch arrangement according to claim 5, wherein said moveable switch bridges each are C-shaped pieces having a center base arm and formed with two bends, respectively, at ends of the base arm, said base arm faces the pair of fixed contacts, said abutment stops of said insulating part engage into the path of movement of said two bends of said C-shaped pieces respectively.

10. The switch arrangement according to claim 4, wherein the plate constituting the insulating part is formed on its ends with detent arms, said housing has corners, said detent arms engage behind said corners.

11. The switch arrangement according to claim 1, further comprising fixed contacts mounted on respective sides of said housing, a moveable change-over switch lever having a path of movement and selectively contacting said fixed contact, respectively, said contact pieces comprise a movable contact piece seated on said change-over switch lever, a stop angle disposed in and limiting the path of movement of said switch lever, abutting the latter on one side of said housing in a position such that movable contact piece is spaced apart from a respective of said fixed contacts, a pivot pin extends out of said housing, said stop angle is disposed on said pivot pin.

12. The switch arrangement according to claim 1, wherein the air space extends completely from one of said cooperating contact pieces to the other of said cooperating contact pieces with nothing therebetween.

* * * * *